US005655725A

United States Patent [19]

Kroger

[11] Patent Number: 5,655,725

[45] Date of Patent: Aug. 12, 1997

[54] RETAINING PLATE FOR GEARING

[75] Inventor: Bruce R. Kroger, West Chicago, Ill.

[73] Assignee: Fellowes Manufacturing Co., Itascha, Ill.

[21] Appl. No.: 519,127

[22] Filed: Aug. 24, 1995

[51] Int. Cl.[6] ..... B02C 18/06

[52] U.S. Cl. ..... 241/236; 241/285.1

[58] Field of Search ..... 241/236, 285.1, 241/100

[56] References Cited

U.S. PATENT DOCUMENTS

| | | |
|---|---|---|
| 1,019,828 | 3/1912 | O'Bryan . |
| 1,090,914 | 3/1914 | Guettler . |
| 1,178,386 | 4/1916 | Edwards . |
| 1,673,336 | 6/1928 | Lehmicke . |
| 1,699,157 | 1/1929 | Pendleton . |
| 1,731,967 | 10/1929 | Antonsen . |
| 2,182,219 | 12/1939 | Ashley . |
| 2,202,843 | 6/1940 | Edwards . |
| 2,216,612 | 10/1940 | Dimm et al. . |
| 2,224,948 | 12/1940 | Bloomquist . |
| 2,236,969 | 4/1941 | Flateboe . |
| 2,259,015 | 10/1941 | Anderson et al. . |
| 2,381,775 | 8/1945 | Roddy . |
| 2,554,114 | 5/1951 | Menkin et al. . |
| 2,657,720 | 11/1953 | Wolfe . |
| 2,696,949 | 12/1954 | Grasse ..... 241/236 |
| 2,770,302 | 11/1956 | Lee . |
| 2,873,923 | 2/1959 | Bergman . |
| 2,894,697 | 7/1959 | Panning et al. . |
| 3,033,064 | 5/1962 | Lee . |
| 3,126,931 | 3/1964 | Blanshine et al. . |
| 3,286,574 | 11/1966 | Durand . |
| 3,369,763 | 2/1968 | Perry . |
| 3,396,914 | 8/1968 | Liebman . |
| 3,510,077 | 5/1970 | Priscu . |
| 3,524,597 | 8/1970 | Burden, Jr. et al. . |
| 3,529,782 | 9/1970 | Liebman . |
| 3,620,461 | 11/1971 | Pelleschi et al. . |
| 3,620,462 | 11/1971 | Dooley, Jr. . |
| 3,630,460 | 12/1971 | Goldhammer . |
| 3,664,592 | 5/1972 | Schweigert et al. . |
| 3,682,402 | 8/1972 | Goldhammer . |
| 3,711,034 | 1/1973 | Ehinger . |
| 3,724,766 | 4/1973 | Bosland . |
| 3,790,093 | 2/1974 | McIntyre . |
| 3,797,765 | 3/1974 | Samuels . |
| 3,860,180 | 1/1975 | Goldhammer . |
| 3,880,361 | 4/1975 | Schwarz . |
| 3,894,697 | 7/1975 | Lawson et al. . |
| 3,921,920 | 11/1975 | Brocard . |
| 3,931,935 | 1/1976 | Holman . |
| 3,960,334 | 6/1976 | Wudyka . |
| 4,009,838 | 3/1977 | Tashman . |
| 4,018,392 | 4/1977 | Wagner . |
| 4,034,918 | 7/1977 | Culbertson et al. . |
| 4,068,805 | 1/1978 | Oswald . |
| 4,106,708 | 8/1978 | Kropa . |
| 4,157,671 | 6/1979 | Goldhammer . |
| 4,172,400 | 10/1979 | Brierley . |
| 4,194,698 | 3/1980 | Kosmowski . |
| 4,200,239 | 4/1980 | Simone et al. . |
| 4,226,372 | 10/1980 | Wigand . |
| 4,257,565 | 3/1981 | Hatanaka . |
| 4,260,115 | 4/1981 | Hatanaka . |
| 4,330,092 | 5/1982 | Roman . |

(List continued on next page.)

FOREIGN PATENT DOCUMENTS

| | | |
|---|---|---|
| 10681 | 10/1979 | European Pat. Off. . |
| 0069721 | 9/1982 | European Pat. Off. . |
| 3001507 | 7/1981 | Germany . |
| 3312173A1 | 11/1984 | Germany . |
| 705066 | 3/1954 | United Kingdom . |
| 1468662 | 5/1973 | United Kingdom . |
| 1502076 | 2/1978 | United Kingdom . |
| 1569375 | 6/1980 | United Kingdom . |
| 2059804 | 8/1980 | United Kingdom . |
| 2097717 | 3/1982 | United Kingdom . |

*Primary Examiner*—John M. Husar

*Attorney, Agent, or Firm*—Brinks Hofer Gilson & Lione

[57] ABSTRACT

A plate for connecting gear shafts in a gear assembly, the plate comprising a rigid body having at least one aperture.

3 Claims, 2 Drawing Sheets

U.S. PATENT DOCUMENTS 4,334,650 6/1982 Hardwick et al. .
4,346,851 8/1982 Bernardi et al. .
4,349,159 9/1982 Hardwick et al. .
4,351,485 9/1982 Hardwick et al. .
4,355,766 10/1982 Wigand .
4,363,453 12/1982 Hill et al. .
4,385,732 5/1983 Williams .
4,394,983 7/1983 Ulsky .
4,399,946 8/1983 Stevenson .
4,411,391 10/1983 Crane .
4,426,044 1/1984 Butler .
4,489,897 12/1984 Turner et al. .
4,522,096 6/1985 Niven, Jr. .
4,545,537 10/1985 Kimura et al. .
4,557,421 12/1985 Probst et al. .
4,558,827 12/1985 Berger .
4,562,971 1/1986 Schwelling .
4,564,146 1/1986 Bleasdale .
4,565,330 1/1986 Katoh .
4,615,490 10/1986 Goldhammer .
4,619,407 10/1986 Goldhammer .
4,625,925 12/1986 Goldhammer .
4,627,581 12/1986 Holiman et al. .
4,627,582 12/1986 Goldhammer .
4,637,560 1/1987 Goldhammer .
4,650,128 3/1987 Goldhammer .
4,651,610 3/1987 Schwelling .
4,657,192 4/1987 Browning .
4,688,730 8/1987 Dahle .
4,690,340 9/1987 Hatanaka .
4,691,871 9/1987 Mochizuki .
4,693,428 9/1987 Raterman et al. .
4,709,197 11/1987 Goldhammer et al. .
4,717,085 1/1988 Crane .
4,773,603 9/1988 Schwelling .
4,809,916 3/1989 Schwelling .
4,830,295 5/1989 Schwelling .
4,860,963 8/1989 Goldhammer et al. .
4,881,692 11/1989 Goldhammer et al. .
4,889,291 12/1989 Goldhammer et al. .
4,919,345 4/1990 Burlington et al. .
4,936,517 6/1990 Kammerer et al. .
4,997,134 3/1991 MacGregor .
5,044,270 9/1991 Schwelling .
5,071,080 12/1991 Herbst et al. .
5,141,168 8/1992 Pepper .
5,170,702 12/1992 Schwelling .
5,230,477 7/1993 Strohmeyer .
5,261,614 11/1993 Schwelling .
5,295,633 3/1994 Kimbro et al. .
5,346,144 9/1994 Stangenberg et al. ..... 241/100
5,409,171 4/1995 Stangenberg et al. .

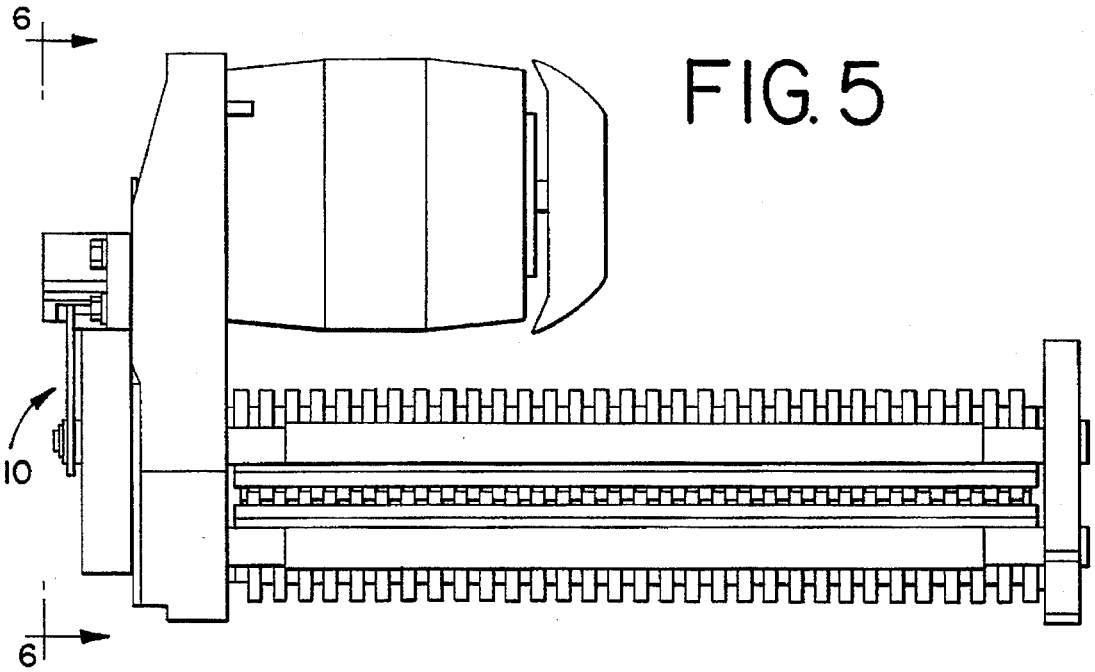
FIG. 5
FIG. 6
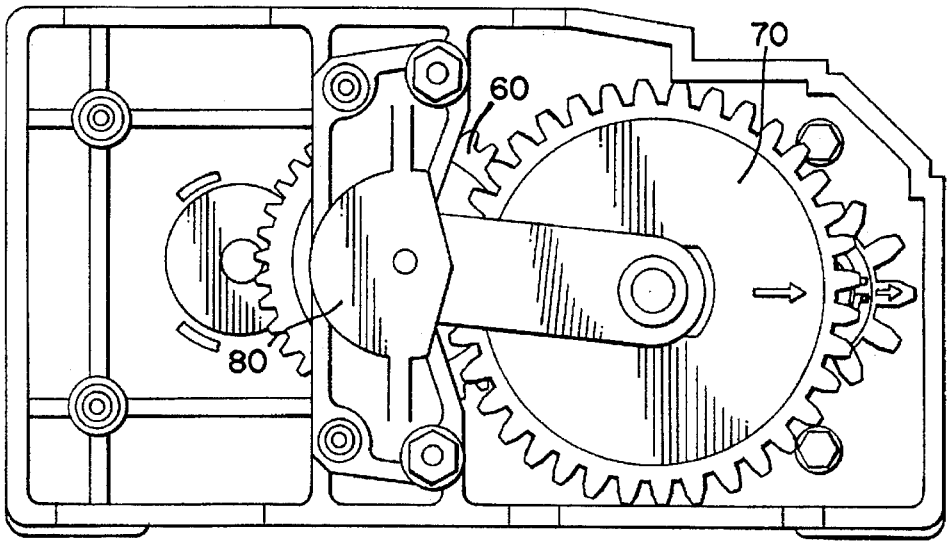
FIG. 7
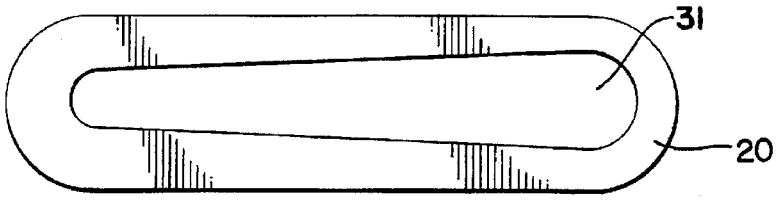

RETAINING PLATE FOR GEARING

BACKGROUND OF THE INVENTION

This invention pertains to the field of gear assemblies. More specifically, the invention encompasses a retaining plate for connecting the gear shafts in a gear assembly.

The following discussion will highlight the advantages of the invention by illustrating its use in a paper shredder. When heavy loads are placed on a paper shredder which has two counter-rotating cutting cylinders, the power provided by the motor tends to distort the cutting mechanism. Many steps can be taken to minimize the effect of this distortion, but it cannot be removed completely. When the cutting mechanism is distorted, it is possible for the gears that drive the cutting mechanism, which are transmitting a great deal of torque, to come out of mesh, skip and possibly break teeth. It is important to find a method to insure that this cannot happen, even when the shredder is abused by attempting to cut more than its rated capacity.

A low-cost, easy to implement device that would ensure that gears under heavy load maintain their proper alignment and orientation would be a welcome improvement in the art.

SUMMARY

The present invention includes a plate for connecting gear shafts in a gear assembly, the plate comprises a rigid body having at least one aperture. The invention also encompasses a paper shredder that incorporates the novel plate.

BRIEF DESCRIPTION OF THE DRAWINGS

FIG. 5 is a top view of a paper shredder which incorporates a plate of the present invention.

FIG. 6 is a cross-sectional view of the paper shredder of FIG. 5 taken along the line 6—6.

FIG. 7 is a top view of a third preferred plate of the present invention.

DETAILED DESCRIPTION OF THE DRAWINGS AND PREFERRED EMBODIMENTS OF THE INVENTION

The present invention relates to a plate for connecting gear shafts in a gear assembly. The plate is used to maintain the orientation and alignment of the gears. Referring to FIGS. 1 through 4, the plate 10 comprises a rigid body 20. The body 20 includes at least one aperture. In the preferred embodiment, the plate 10 includes two apertures 30 and 40. The distance between the apertures should correspond exactly with the distance between the gear shafts that need to be connected. Likewise, the size of the apertures 30, 40 is dependent on the size of the gear shafts to be connected.

Figure 1:
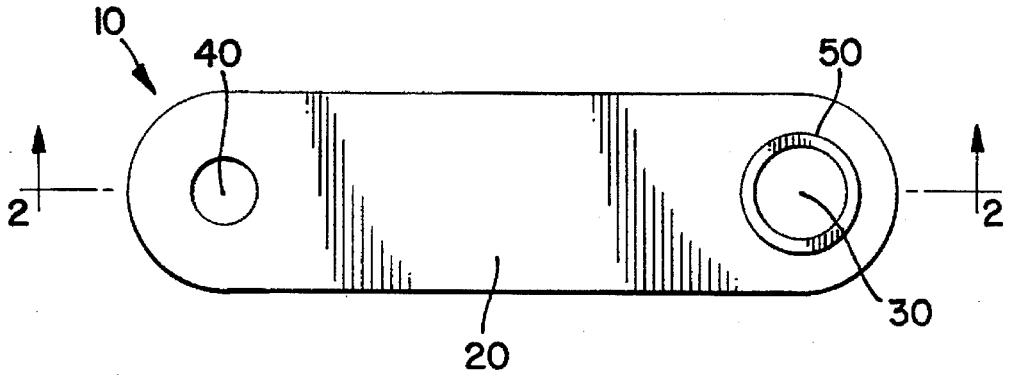
FIG. 1 is a top view of a first preferred plate of the present invention.
Figure 2:
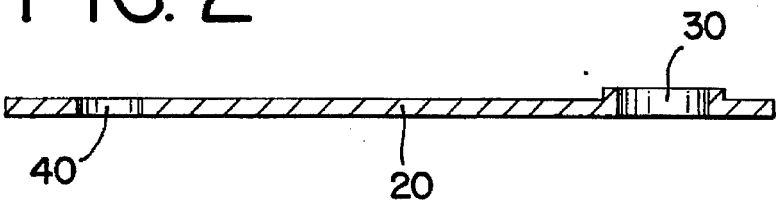
FIG. 2 is a cross-sectional view of the plate of FIG. 1 taken along the line 2—2.

The plate 10 may also include a flange 50 on some or all of the apertures, as illustrated in FIG. 1. The flange 50 allows the plate 10 to be used without a bearing.

The plate 10 of the present invention could easily be utilized on a paper shredder. U.S. Pat. Nos. 5,071,080 issued to Herbst et al. and 5,295,633 issued to Kimbro et al., herein incorporated by reference, describe paper shredders. FIGS. 5 and 6 illustrate the plate 10 in use on a paper shredder. The plate 10 is placed onto the outer extensions of the gear shafts which must be held in mesh. The plate 10 may be used with any number of gears that work together. The plate 10 is preferably used with a pair of gears. Referring to FIG. 6, the plate 10 is used to connect a driving gear 60 to the driven gear 70. The pinion of the driving gear 60, which must be held in mesh with the driven gear 70, is hidden by the plate 10 and the gear cover 80. Once the plate 10 is properly positioned, it is not possible to modify the orientation of the gears even if the cutting mechanism becomes distorted.

The plate 10 may be made from any rigid material that is strong enough to maintain the gear shafts in their proper orientation. Preferably, the plate 10 is made of cold rolled steel.

Figure 3:
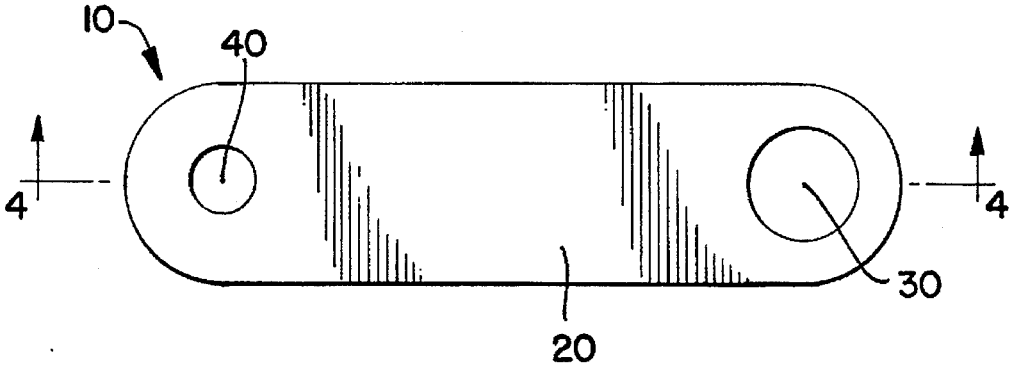
FIG. 3 is a top view of a second preferred plate of the present invention.
Figure 4:
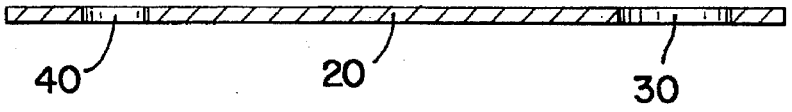
FIG. 4 is a cross-sectional view of the plate of FIG. 3 taken along the line 3—3.

There are numerous possible modifications to the plate 10 described above. For example, as stated above, the plate may have more than two apertures. Alternately, as shown in FIG. 7, the plate may have one relatively large aperture 31 in the center of the body 20. In this embodiment, the circumference of the aperture would provide the resistance needed to maintain the gear shafts in their proper orientation. In addition, the plate 10 can be made without any flanges 50, as depicted in FIGS. 3 and 4. In this instance, the plate 10 must be used with a bushing or bearing inserted into the larger of the two apertures.

It should be appreciated that the apparatus of the present invention is capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive, and the scope of the invention is, therefore, indicated by the appended claims rather than by the foregoing description. All changes which come within the scope and range of equivalency of the claims are to be embraced within their scope.

What is claimed:

1. A paper shredder comprising:

a) a cutting mechanism comprising at least two gear shafts each having outer extensions and at least two gears;

b) a plate disposed on the outer extensions of the gear shafts connecting at least two of the gear shafts such that the gears are located between the plate and the gear shafts, the plate comprising a rigid body and at least one aperture; and wherein one of the connected gear shafts is also a cutting shaft.

2. The plate recited in claim 1 having two apertures.

3. The plate recited in claim 1 further comprising a flange on at least one of the apertures.

* * * * *